US011180305B2

(12) United States Patent
Miura et al.

(10) Patent No.: US 11,180,305 B2
(45) Date of Patent: Nov. 23, 2021

(54) MICROWAVE POUCH

(71) Applicant: Toyo Seikan Co., Ltd., Tokyo (JP)

(72) Inventors: Takashi Miura, Yokohama (JP); Kazumi Ozawa, Tokyo (JP); Masahiro Hongou, Yokohama (JP); Shie Matsunaga, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 439 days.

(21) Appl. No.: 16/305,495

(22) Filed: Nov. 29, 2018

(65) Prior Publication Data

US 2019/0135521 A1 May 9, 2019

Related U.S. Application Data

(63) Continuation of application No. PCT/JP2017/018891, filed on May 19, 2017.

(30) Foreign Application Priority Data

Jun. 2, 2016 (JP) ..... JP2016-110798

(51) Int. Cl.
*B65D 81/34* (2006.01)
*B65D 33/01* (2006.01)

(52) U.S. Cl.
CPC ..... *B65D 81/3461* (2013.01); *B65D 33/01* (2013.01); *B65D 81/34* (2013.01); *B65D 2205/02* (2013.01)

(58) Field of Classification Search
CPC ..... B65D 81/3461; B65D 33/01; B65D 81/34
(Continued)

(56) References Cited

U.S. PATENT DOCUMENTS 4,530,440 A 7/1985 Leong
2005/0255200 A1* 11/2005 Takahagi ..... B65D 75/008 426/113

(Continued)

FOREIGN PATENT DOCUMENTS

EP 1 067 058 A1 1/2001
JP 2001270569 A * 10/2001

(Continued)

OTHER PUBLICATIONS

Machine translation of JP-2001270569-A.*

(Continued)

*Primary Examiner* — Jes F Pascua
(74) *Attorney, Agent, or Firm* — Westerman, Hattori, Daniels & Adrian, LLP

(57) ABSTRACT

To provide a microwave pouch that favorably prevents both of hole formation of the pouch and spurting of contents, with a simple structure. A microwave pouch (10) includes a self-venting mechanism (20). The self-venting mechanism (20) has an annular venting seal (30), a steam release part (40) surrounded by the venting seal (30), and a movable piece (60) defined by a slit (50) formed in the steam release part (40). The venting seal (30) has a seal peel initiation part (31) where peeling is started by steam generated inside the pouch (10) during heating. The slit (50) includes slit both ends (51), and a slit intermediate part (52) formed to extend from the slit both ends (51) toward a region away from the seal peel initiation part (31) and connecting the slit both ends.

11 Claims, 15 Drawing Sheets

(58) Field of Classification Search
USPC ..... 383/103
See application file for complete search history.

(56) References Cited

U.S. PATENT DOCUMENTS

| | | | | |
|---|---|---|---|---|
| 2006/0257056 | A1* | 11/2006 | Miyake | B65D 77/225 383/103 |
| 2007/0023425 | A1* | 2/2007 | Kanzaki | B65D 75/5805 219/727 |
| 2007/0071855 | A1 | 3/2007 | Kanzaki | |
| 2014/0263292 | A1 | 9/2014 | Bosman | |
| 2020/0017276 | A1* | 1/2020 | Hongou | B65D 81/3461 |

FOREIGN PATENT DOCUMENTS

| | | | | |
|---|---|---|---|---|
| JP | 2003-192042 | A | | 7/2003 |
| JP | 2005-082172 | A | | 3/2005 |
| JP | 2006321519 | A | * | 11/2006 |
| JP | 2007-191199 | A | | 8/2007 |
| JP | 2009-273382 | A | | 11/2009 |
| WO | 2005/051800 | A1 | | 6/2005 |
| WO | 2010/038079 | A1 | | 4/2010 |

OTHER PUBLICATIONS

International Search Report dated Jul. 18, 2017, issued in counterpart International Application No. PCT/JP2017/018891 (2 pages).
Extended Search Report dated Nov. 26, 2019, issued in counterpart EP Application No. 17806421.8 (8 pages).

* cited by examiner

MICROWAVE POUCH

TECHNICAL FIELD

The present invention relates to a microwave pouch formed in a bag shape by thermally bonding together overlapped layers of laminated film and provided with a self-venting mechanism for automatic release of steam from inside during the heating.

BACKGROUND ART

Packaged foods that can be heated (cooked) in a microwave to be ready for eating have been widely available in the market, wherein a pouch formed in a bag shape by thermally bonding together overlapped layers of laminated film contains cooked or half-cooked food products inside.

Such a pouch, when heated in a microwave, entails a risk of tear or deformation resulting from an internal pressure buildup caused by the steam generated from the food and thermal expansion of the air inside, and a risk of food scattering from the pouch in the event of a tear.

Therefore, microwave pouches in recent years are commonly provided with a self-venting mechanism for automatic release of steam from inside during the heating. One known pouch with such a self-venting mechanism includes an annular venting seal formed by thermally bonding together part of overlapped layers of laminated film, and a vent hole provided in a steam release part surrounded by the annular venting seal (see, for example, Patent Literature 1).

When the pressure inside this pouch described in Patent Literature 1 builds up as the pouch is heated in a microwave, part of the annular venting seal (outer seal) peels so that a path that connects to the steam release part (buffer) is formed. The steam inside the pouch is thus discharged to the outside through the peeled portion and the vent hole (weakened portion).

CITATION LIST

Patent Literature

Patent Literature 1: Japanese Patent Application Laid-open No. 2003-192042

SUMMARY OF INVENTION

Technical Problem

However, the self-venting mechanism disclosed in Patent Literature 1 has the following problems as regards the design of the vent hole.

If the opening area of the vent hole is small, such as when the vent hole is formed in a circular shape, while spurting of the contents from the vent hole may be minimized, the steam cannot be discharged in a sufficient amount. The pouch expanded by steam may be kept in this condition for long enough to allow formation of a hole due to thermal damage of the inner face material of the pouch.

On the other hand, if the vent hole is formed in an elliptic shape to have a large opening area, a sufficient steam discharge amount can be secured to reduce the possibility of hole formation in the pouch as noted above, while, depending on the properties of the contents, the contents may more easily spurt out.

Accordingly, an object of the invention is to solve these problems and provide a microwave pouch that favorably prevents both of hole formation of the pouch and spurting of contents, with a simple structure.

Solution to Problem

The present invention solves the problems described above by providing a microwave pouch having a self-venting mechanism, the self-venting mechanism including an annular venting seal, a steam release part surrounded by the venting seal, and a movable piece defined by a slit formed in the steam release part. The venting seal includes a seal peel initiation part where peeling is started by steam generated inside the pouch during heating. The slit includes slit both ends formed in the steam release part, and a slit intermediate part formed to extend from the slit both ends toward a region away from the seal peel initiation part and connecting the slit both ends.

The present invention solves the problems described above by providing a microwave pouch including a self-venting mechanism, the self-venting mechanism including an annular venting seal, a steam release part surrounded by the venting seal, and a vent portion formed in the steam release part. The venting seal includes a seal peel initiation part where peeling is started by steam generated inside the pouch during heating. The vent portion includes an ejection port that is formed during heating of the pouch. The ejection port is configured to open laterally relative to a direction in which steam and contents enter the steam release part from the seal peel initiation part.

Advantageous Effects of Invention

According to one aspect of the present invention the self-venting mechanism includes a steam release part surrounded by the venting seal, and a movable piece defined by a slit formed in the steam release part, and the slit includes slit both ends, and a slit intermediate part formed to extend from the slit both ends toward a region away from the seal peel initiation part and connecting the slit both ends. When the venting seal starts peeling due to increased internal pressure of the pouch, the laminated films forming the movable piece defined by the slit tilt in the same direction either to the front side or backside of the pouch due to entrance of steam into the steam release part or deformation or the like of the pouch. This results in formation of an ejection port that opens out of the pouch near the slit both ends. Since this ejection port opens laterally relative to the direction in which the contents enter into the steam release part from the peeled portion of the venting seal, spurting of the contents from the ejection port can be minimized, while the steam is let out from the ejection port.

According to another aspect of the present invention, part of the slit intermediate part is formed in the venting seal. This allows the front and back laminated films of the movable piece to maintain partially bonded together, so that the ejection port can be formed in a favorable manner.

According to another aspect of the present invention, a point seal is provided in the movable piece defined by the slit, by thermally bonding together layers of the movable piece. This point seal allows the front and back laminated films of the movable piece to maintain partially bonded (adhered) together, so that the ejection port can be formed in a favorable manner.

According to another aspect of the present invention, the slit has a width along a slit extending direction, so that the reliability of the movable piece tilting either to the front side or backside of the pouch can be improved, and also, the presence or condition of the slit can be more easily checked from outside.

According to another aspect of the present invention, the self-venting mechanism includes an annular venting seal, a steam release part surrounded by the venting seal, and a vent portion formed in the steam release part. The venting seal includes a seal peel initiation part where peeling is started by steam generated inside the pouch during heating. An ejection port that is formed in the vent portion during heating of the pouch is configured to open laterally relative to a direction in which steam and contents enter the steam release part from the seal peel initiation part. Thus, while the steam is let out from the ejection port, spurting of the contents from the ejection port can be minimized.

According to another aspect of the present invention, the vent portion is formed of a slit, and the slit includes slit both ends, and a slit intermediate part formed to extend from the slit both ends toward a region away from the seal peel initiation part and connecting the slit both ends. When the venting seal starts peeling due to increased internal pressure of the pouch, laminated films of a section defined by the slit tilt in the same direction either to the front side or backside of the pouch due to entrance of steam into the steam release part or deformation or the like of the pouch. This results in formation of an ejection port that opens out of the pouch near the slit both ends. Since this ejection port opens laterally relative to the direction in which the contents enter into the steam release part from the peeled portion of the venting seal, spurting of the contents from the ejection port can be minimized, while the steam is let out from the ejection port.

According to another aspect of the present invention, a length and a width of the movable piece are set to be 3 mm or more, so that the tilting of the movable piece to the front side or backside of the pouch can be controlled more reliably, and thus the ejection port can be formed in a favorable manner near the slit both ends.

According to another aspect of the present invention, the slit intermediate part has end portions each on either side at the slit both ends, and the pair of end portions are formed such that the end portions are increasingly spaced apart from each other as the end portions extend further from the seal peel initiation part. Thus the distance between the slit both ends can be made shorter, so that the movable piece can tilt more easily to the front side or backside of the pouch. This not only facilitates formation of the ejection port near the slit both ends, but also allows the ejection port to open laterally and backward relative to the direction in which the steam and contents enter the steam release part. Thus spurting of the contents from the ejection port can be minimized more reliably.

REFERENCE SIGNS LIST

Figure 1:
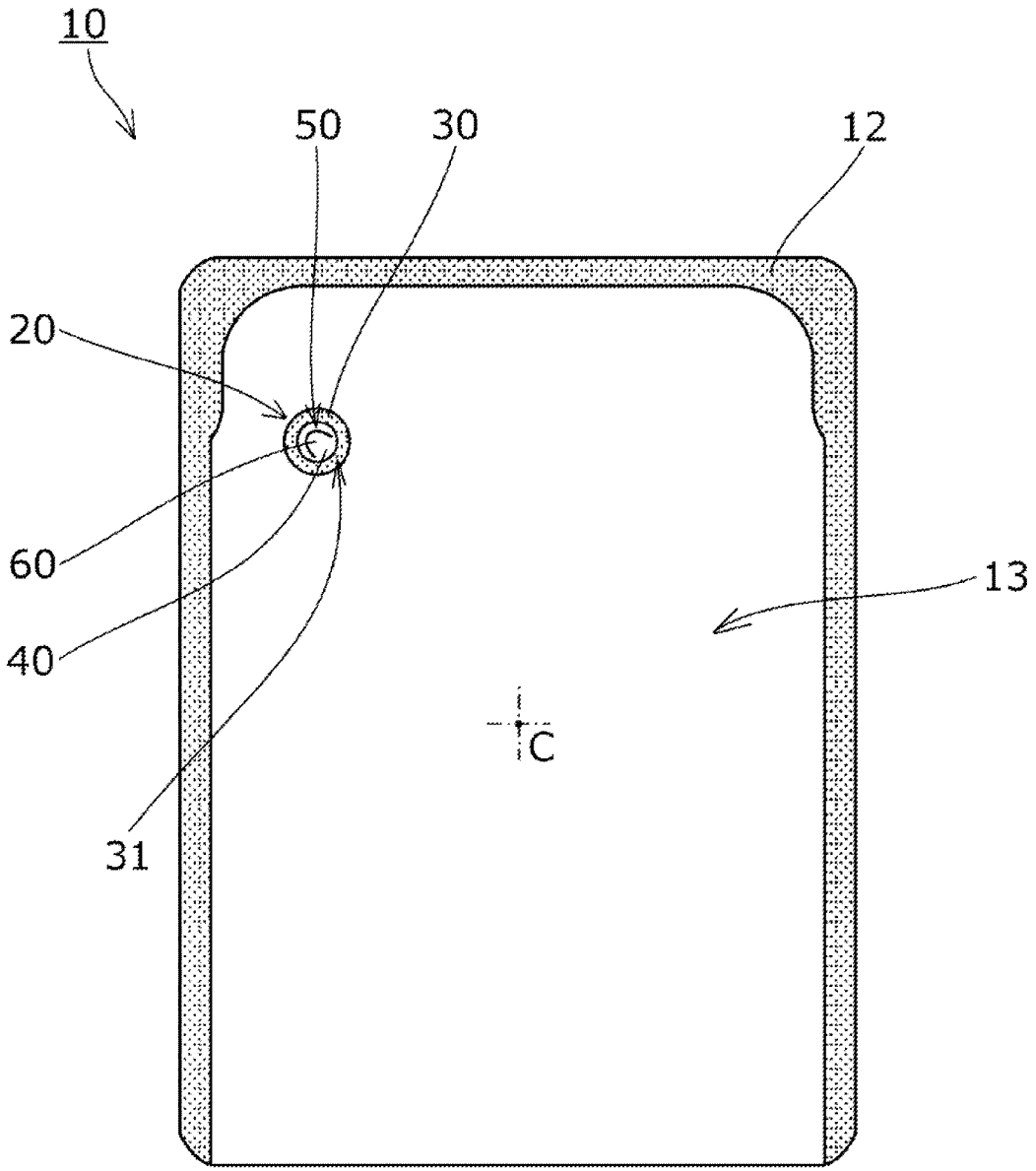
FIG. 1 is a plan view illustrating a pouch according to one embodiment of the present invention.

10 Pouch
11 Laminated film
12 Outer edge seal
13 Container part
20 Self-venting mechanism
30 Venting seal
31 Seal peel initiation part
32 Strong seal part
33 Weak seal part
34 Straight portion
40 Steam release part
50 Slit
51 Slit both end
52 Slit intermediate part
52*a* End portion
60 Movable piece
61 Connecting portion
62 Point seal
70 Ejection port
C Center of container part

DESCRIPTION OF EMBODIMENTS

Hereinafter, a microwave pouch 10 according to one embodiment of the present invention will be described with reference to the drawings.

First, the pouch 10 is formed in a bag shape as shown in FIG. 1 by thermally bonding together outer edges of overlapped layers of laminated film 11 to form an outer edge seal 12, with a container part 13 inside holding contents such as food.

The pouch 10 is provided with a self-venting mechanism 20 configured to automatically release the steam from inside the pouch 10 to the outside during the heating.

The self-venting mechanism 20 includes, as shown in FIG. 1, a annular venting seal 30 formed by bonding together the overlapped layers of laminated film 11 with heat, a steam release part 40 that is an inside part surrounded by the annular venting seal 30, a slit 50 (vent portion) formed in this steam release part 40, and a movable piece 60 defined by the slit 50.

Below, various constituent parts of the self-venting mechanism 20 will be described with reference to FIG. 1 to FIG. 4B.

First, the venting seal 30 is formed in an annular shape in one inner corner of the outer edge seal 12 independently of the outer edge seal 12, as shown in FIG. 1.

The venting seal 30 includes a seal peel initiation part 31 where peeling is started by the steam generated inside the pouch 10 during the heating in the microwave (so that the radially outer side and the inner side of the venting seal 30 communicate with each other). In this embodiment, the seal peel initiation part 31 is a section of the annular venting seal 30 closest to the center C of the container part 13, as shown in FIG. 1.

The steam release part 40 is formed as a non-sealed portion where the overlapped front and back layers of laminated film 11 are not thermally bonded together.

The steam release part 40 is not limited to this specific form and may be, for example, provided as a weak bond portion where the front and back laminated films 11 are thermally bonded together more weakly than in the outer edge seal 12 or venting seal 30. Alternatively, the steam release part 40 may be formed as a bond portion with a pattern such as knurling provided in the front and back laminated films 11.

Figure 3:
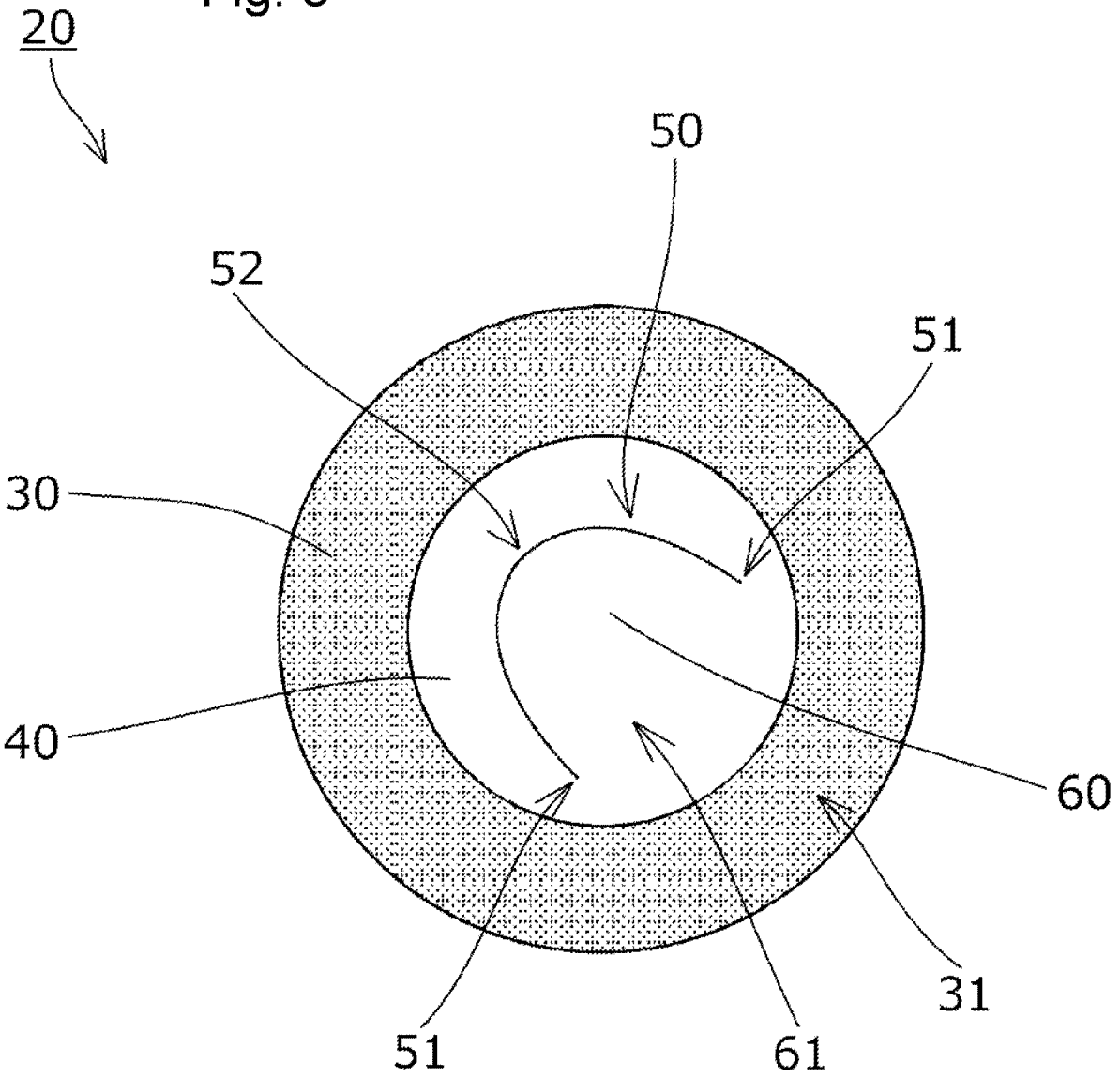
FIG. 3 is a plan view illustrating the self-venting mechanism.
Figure 4A:
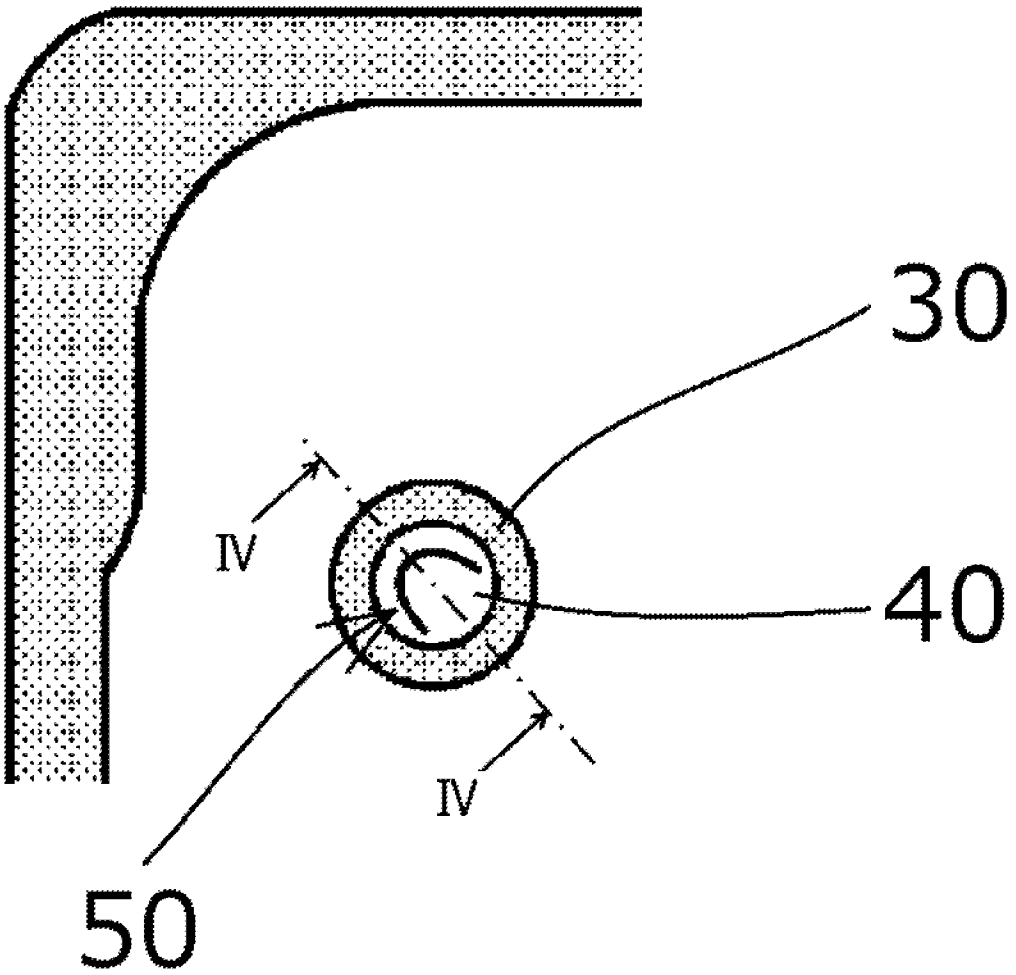
FIG. 4A is a plan view illustrating the vicinity of the self-venting mechanism.
Figure 4B:
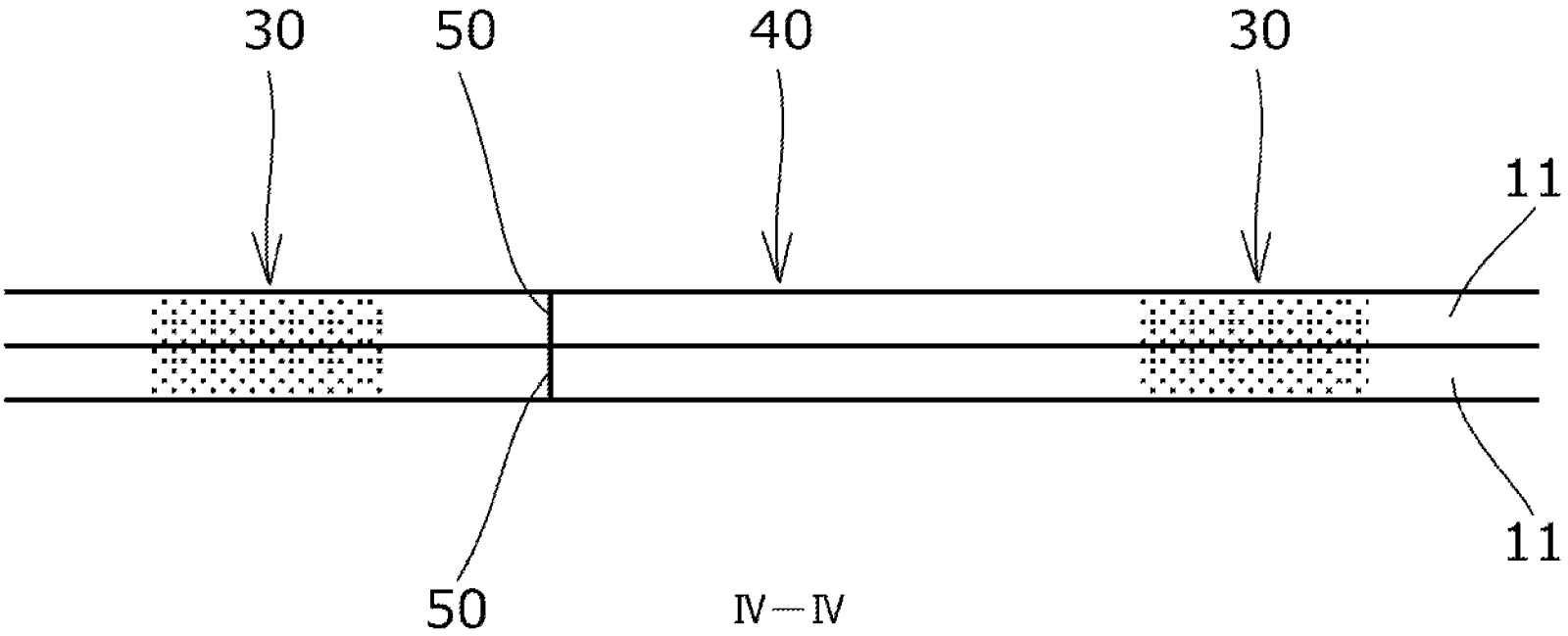
FIG. 4B is a cross-sectional view of the self-venting mechanism taken along the line IV-IV of FIG. 4A.

The slit 50 is formed to extend through the overlapped front and back layers of laminated film 11 in the front and back direction as shown in FIGS. 4A and 4B. As shown in FIG. 3, the slit includes slit both ends 51 formed in the steam release part 40, and a U-shaped slit intermediate part 52 extending from the slit both ends 51 toward a region away from the seal peel initiation part 31 and connecting the slit both ends 51.

Figure 2:
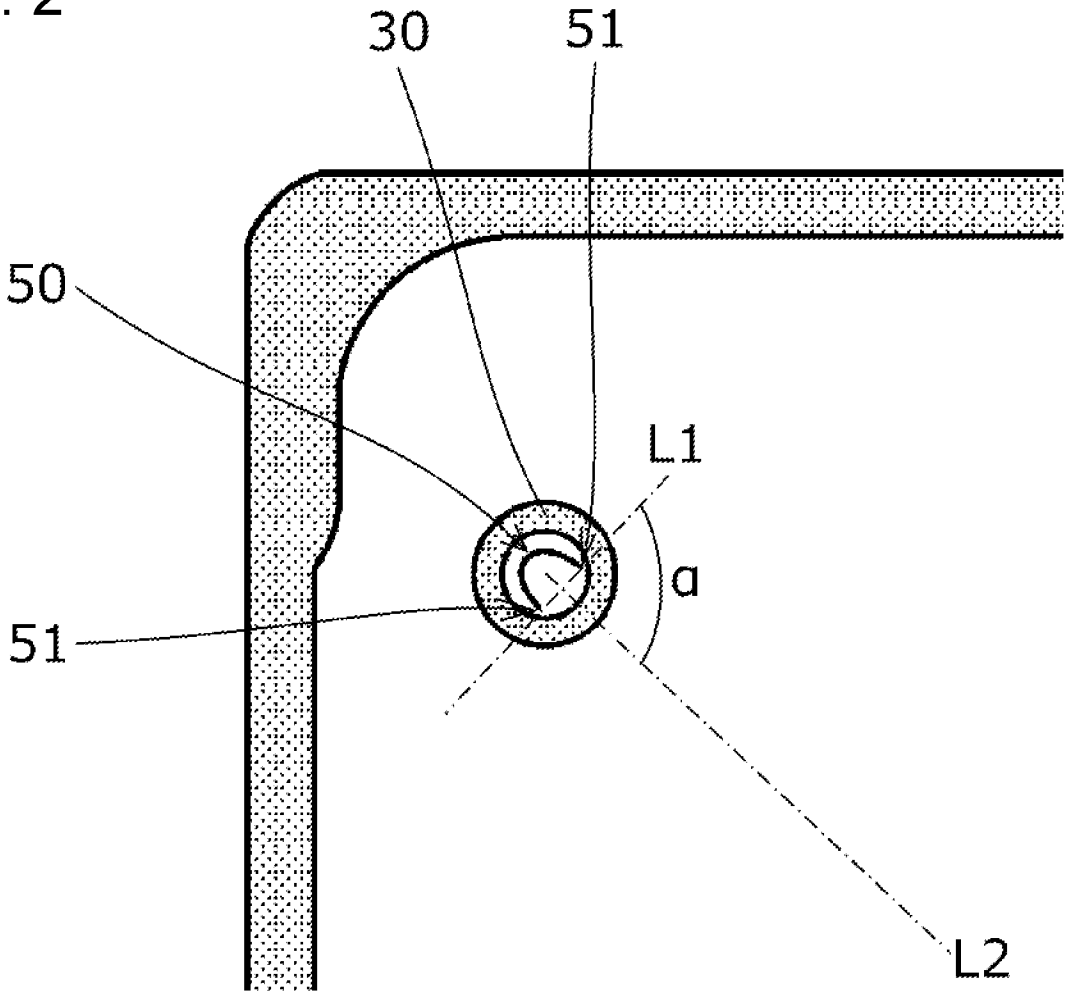
FIG. 2 is a plan view illustrating the vicinity of a self-venting mechanism.

In this embodiment, as shown in FIG. 2, the positions of the slit both ends 51 are determined such that an imaginary line L1 connecting the slit both ends 51 intersects orthogonally with an imaginary line L2 connecting the center C of the container part 13 and the center of the steam release part 40.

The positions of the slit both ends 51 are not limited to those specified above. The positions of the slit both ends 51 should preferably be determined such that the angle $\alpha$ between the imaginary line L1 and the imaginary line L2 is from 45° to 135°, or such that the imaginary line L1 is at an angle substantially parallel to a center axis line of the pouch 10. The angle should preferably be within this range because, if the angle is out of the range specified above, it will be hard to form a steam ejection port 70 to be described later and shown in FIG. 6.

The movable piece 60 is a section partially separated from the surrounding area by the formation of the slit 50 as shown in FIG. 3, and includes a connecting portion 61 that connects the section to a surrounding portion at an outer circumferential edge position facing the seal peel initiation part 31.

Next, how the various parts will work when the pouch 10 of this embodiment is heated will be described below with reference to FIG. 5 and FIG. 6.

First, when the pouch 10 is heated in a microwave, the internal pressure of the pouch 10 builds up because of the steam generated from the contents such as food and the thermal expansion of the inside air, this pressure causing a force applied radially from the center C of the container part 13.

Figure 5:
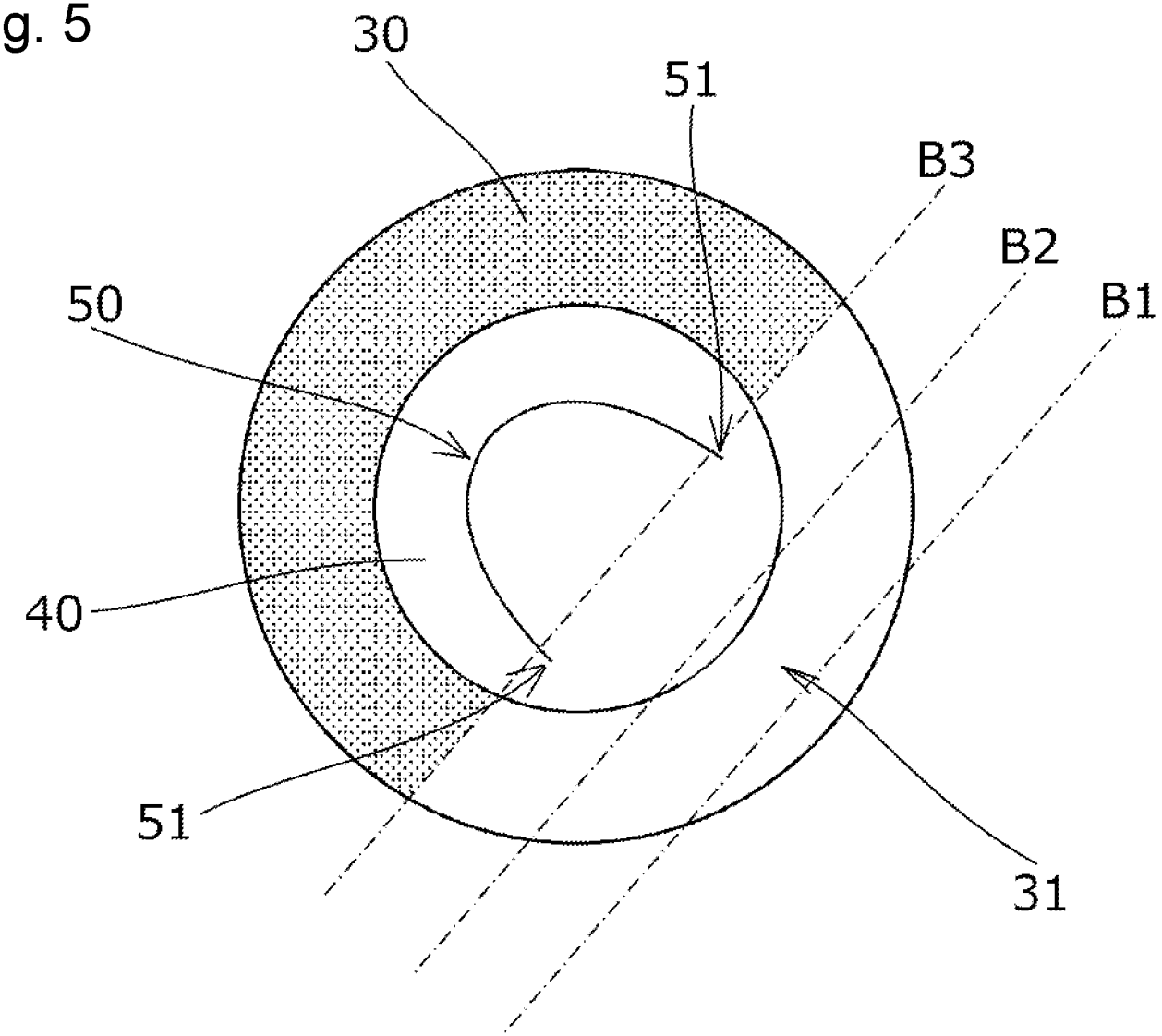
FIG. 5 is an illustrative diagram showing a state of the self-venting mechanism when the pouch is heated.

Next, the radially expanding force causes the venting seal 30 to start peeling from a point close to the center C of the container part 13 (seal peel initiation part 31), in particular, the portion closest to the center C of the container part 13, as shown in FIG. 5. This peeling of the venting seal 30 progresses in a direction away from the center C of the container part 13, in the order of broken lines B1, B2, and B3. The broken lines B1 to B3 shown in FIG. 5 indicate boundary lines between a peeled portion and an unpeeled portion.

Peeling progresses similarly in the steam release part 40 in the order of broken lines B1, B2, and B3.

Namely, the front and back laminated films 11 that form the steam release part 40 are in tight contact with each other before the venting seal 30 starts peeling. Once the venting seal 30 starts to peel, however, the peeling progresses in the direction away from the center C of the container part 13 by the radially expanding force.

Figure 6:
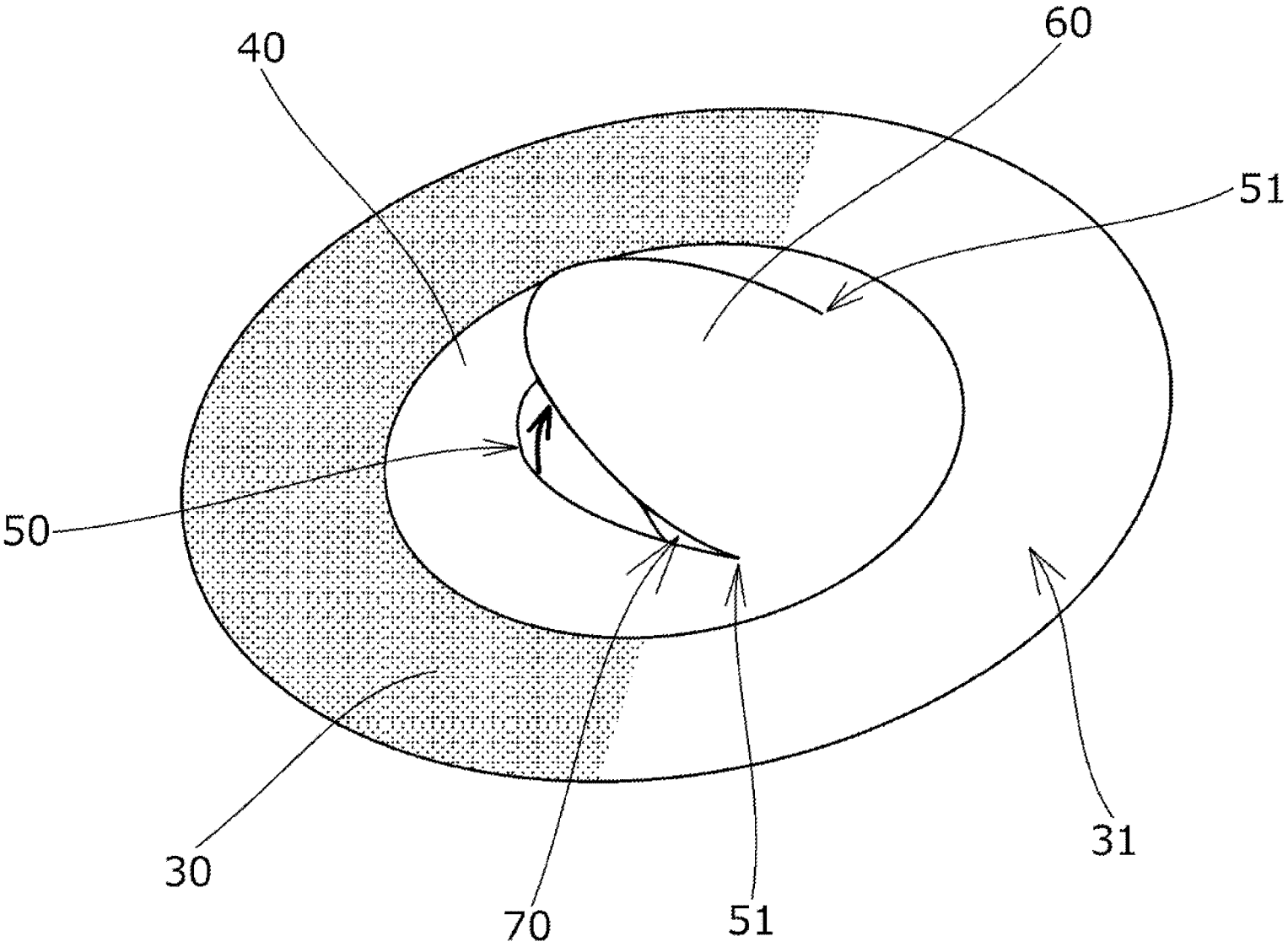
FIG. 6 is a perspective view illustrating a state of the self-venting mechanism when the pouch is heated.

Next, at a time point when the peeling of the venting seal 30 and the steam release part 40 reaches the broken line B3, the laminated films 11 forming the movable piece 60 (steam release part 40) tilt in the same direction either to the front side or backside of the pouch 10 as shown in FIG. 6 due to entrance of steam into the steam release part 40 or deformation or the like of the pouch 10. This results in formation of an ejection port 70 for the steam that opens in a substantially triangular shape to the outside of the pouch 10, near the slit both ends 51.

The ejection port 70 opens laterally relative to the direction in which the contents enter into the steam release part 40 from the peeled portion of the venting seal 30 (which is the direction away from the center C of the container part 13 in this embodiment), so that, while the steam is let out from the ejection port 70, spurting of the contents from the ejection port 70 can be minimized, i.e., the contents are stopped from spewing out by the laminated films 11 forming the movable piece 60.

After the steam starts to be discharged from the ejection port 70, the peeling of the venting seal 30 and the steam release part 40 no longer advances, i.e., the peeling of the venting seal 30 and the steam release part 40 does not progress further than the broken line B3.

Accordingly, the laminated films 11 forming the movable piece 60 remain in tight contact with (adhered to) each other on the distal end side (further from the center C of the container part 13).

As described above, with the microwave pouch 10 provided with a self-venting mechanism, spurting from the ejection port 70 can be minimized by the following characteristics: the self-venting mechanism 20 includes an annular venting seal 30, a steam release part 40 surrounded by the venting seal 30, and a vent portion formed in the steam release part 40; the venting seal 30 includes a seal peel initiation part 31 where peeling is started by steam generated inside the pouch during heating; the vent portion includes an ejection port 70 that is formed during heating of the pouch; and the ejection port 70 is configured to open laterally relative to a direction in which steam and contents enter the steam release part 40 from the seal peel initiation part 31.

The microwave pouch is also characterized in that the venting portion is formed of a slit 50, and the slit 50 includes slit both ends 51, and a slit intermediate part 52 formed to extend from the slit both ends 51 toward a region away from the seal peel initiation part 31 and connecting the slit both ends 51. When the venting seal 30 starts peeling due to increased internal pressure of the pouch 10, laminated films 11 of a section defined by the slit 50 tilt in the same direction either to the front side or backside of the pouch 10 due to entrance of steam into the steam release part 40 or deformation or the like of the pouch 10. This results in formation of an ejection port 70 that opens out of the pouch 10 near the slit both ends 51. This ejection port 70 opens laterally relative to the direction in which the contents enter into the steam release part 40 from the peeled portion of the venting seal 30, which is preferable, because spurting of the contents from the ejection port 70 can be minimized, while the steam is let out from the ejection port 70.

While one embodiment of the present invention has been described in detail above, the present invention is not limited to the embodiment described above, and various design changes are possible without departing from the scope of the present invention set forth in the claims.

For example, the laminated film 11 may be a synthetic resin film made of any of polyester, polypropylene, polyamide and the like, or may be formed in any specific manner, such as by laminating a known synthetic resin film with a coating film or a deposited film that adds gas barrier properties or water barrier properties on any of the synthetic resin films noted above, or by laminating paper or aluminum foil on any of the synthetic resin films noted above.

In the embodiment described above, one laminated film 11 is bent in two, and bonded together with heat along the remaining three sides other than the fold line to form the pouch 10 in a bag shape. The pouch 10 is not limited to this specific form, and may be formed, for example, by overlapping two sheets of laminated film 11 upon one another and thermally bonding them together along the four sides into a bag shape, or by various other known forming methods. The pouch 10 may have any other shapes than the quadrilateral shape shown in the embodiment described above, such as trapezoid, for example, or irregular shapes with some recesses and protrusions.

While the contents of the pouch 10 were described as food in the embodiment described above, the pouch may contain other specific contents that are not limited to food.

In the embodiment described above, the venting seal 30 was described as being formed in an annular shape inside the outer edge seal 12 independently, but the venting seal 30 is not limited to the specific form described above and may be formed, for example, so as to be continuous with the outer edge seal 12, or, the venting seal 30 may be formed in other shapes such as a square frame shape.

Figure 9:
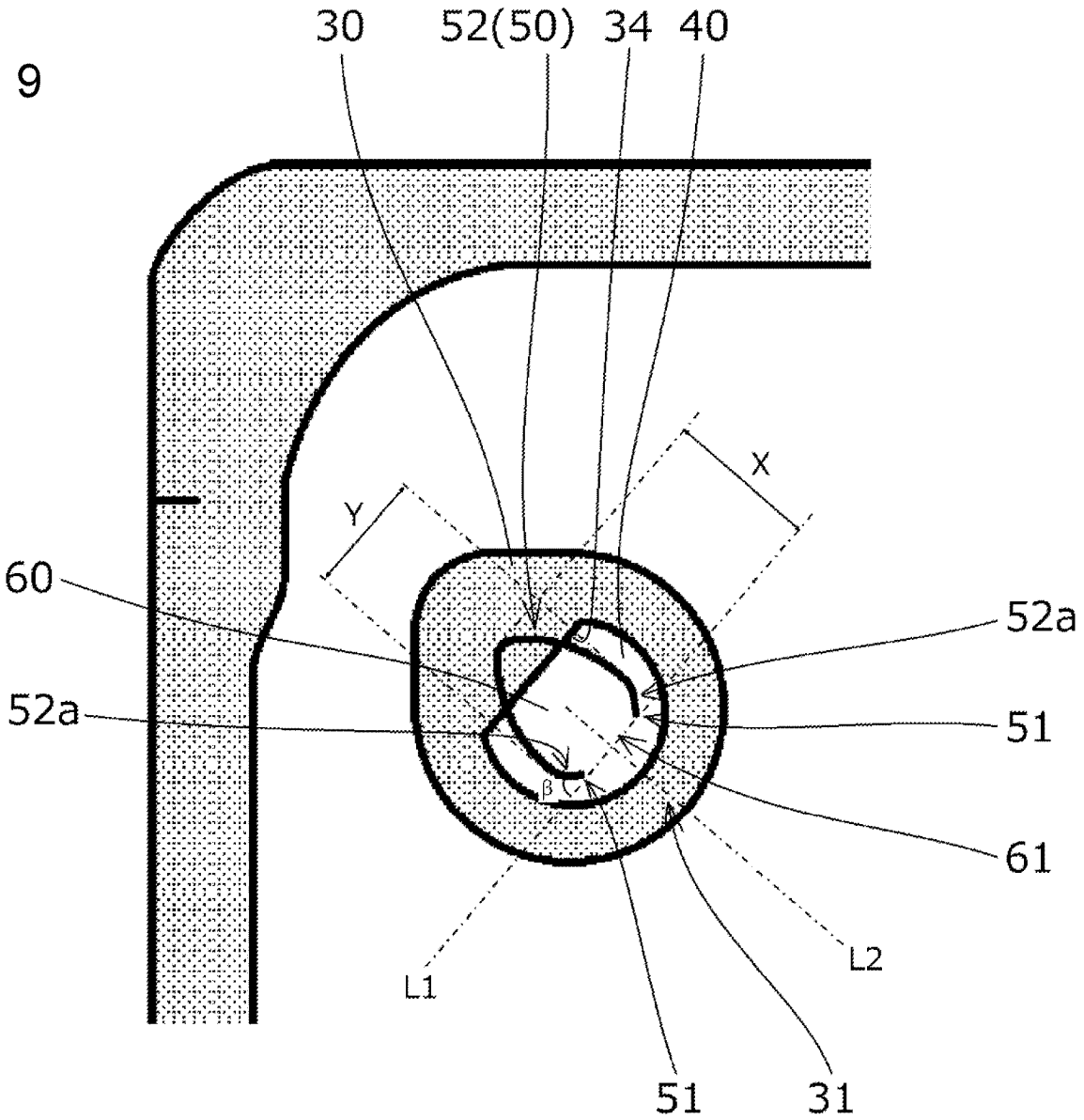
FIG. 9 is a plan view illustrating the vicinity of the self-venting mechanism of the pouch shown in FIG. 8 to a larger scale.

As shown in FIG. 9, the venting seal 30 may also be formed such that part of the circular outer edge of the venting seal 30 (in the example of FIG. 9, a portion corresponding to the peak of the slit 50) is protruded outward in accordance with the size of the slit 50 and the position and the like of the slit 50.

Figure 7A:
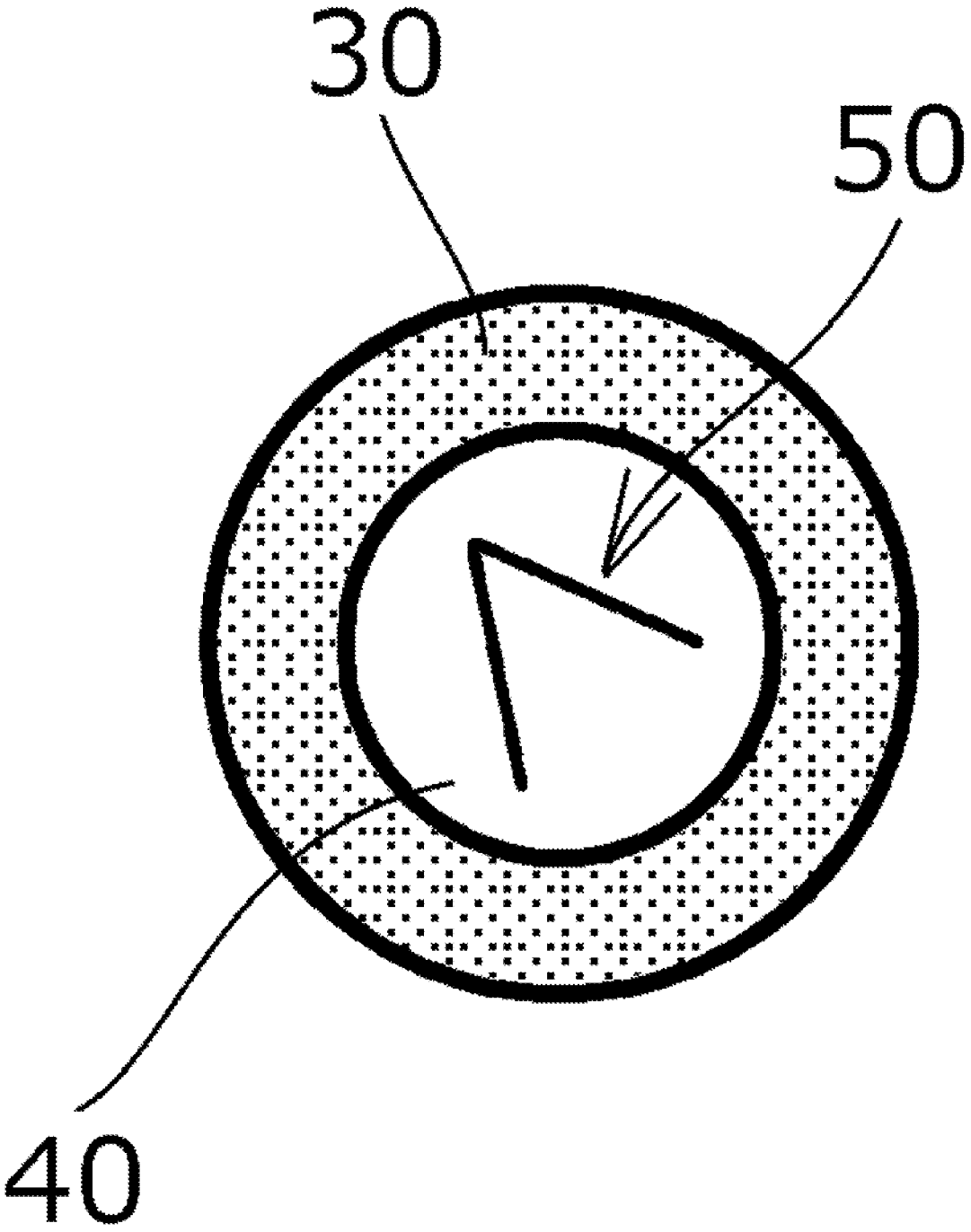
FIG. 7A is a plan view illustrating one of variation example of the self-venting mechanism.
Figure 7B:
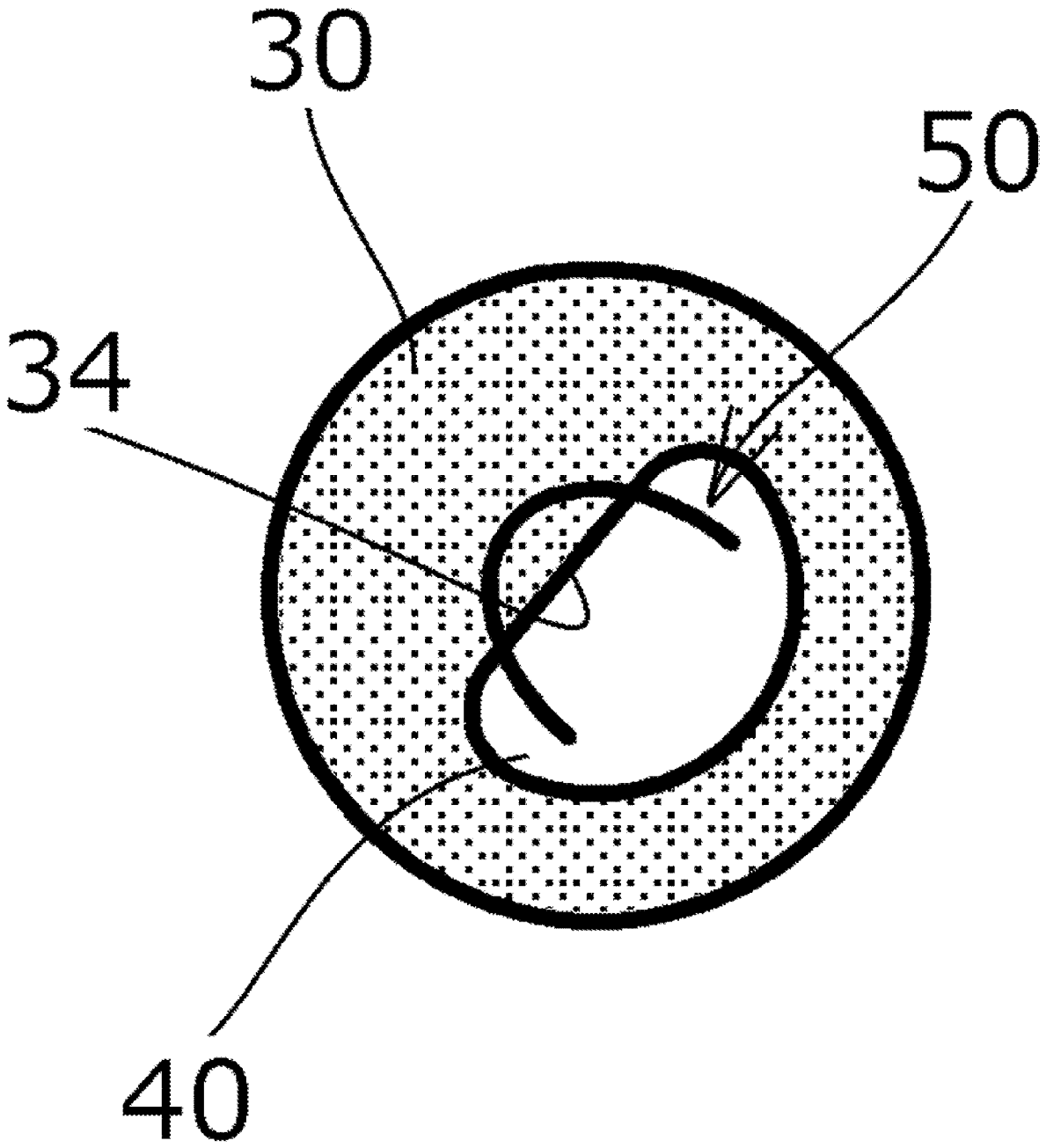
FIG. 7B is a plan view illustrating another variation example of the self-venting mechanism.
Figure 7C:
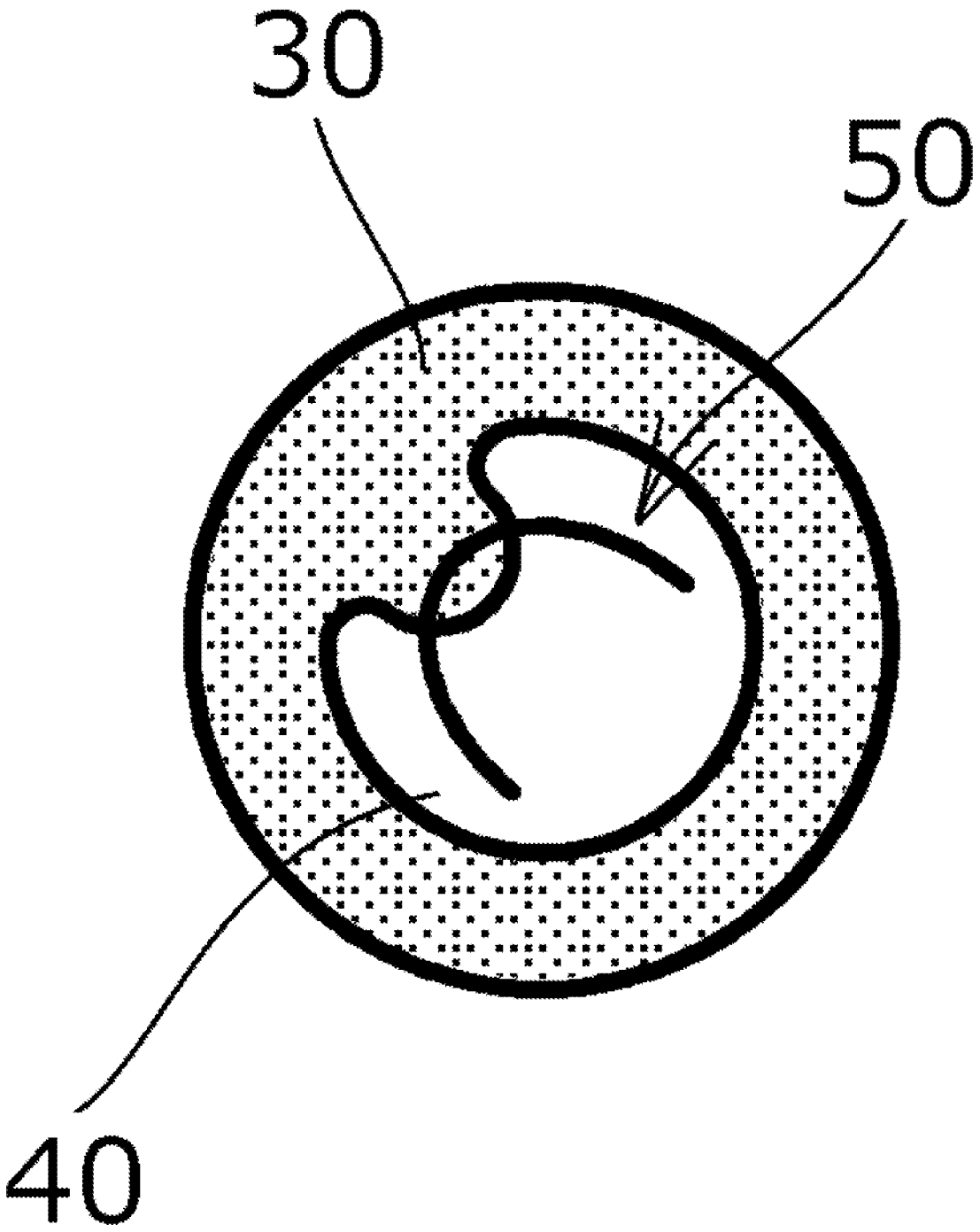
FIG. 7C is a plan view illustrating another variation example of the self-venting mechanism.
Figure 7D:
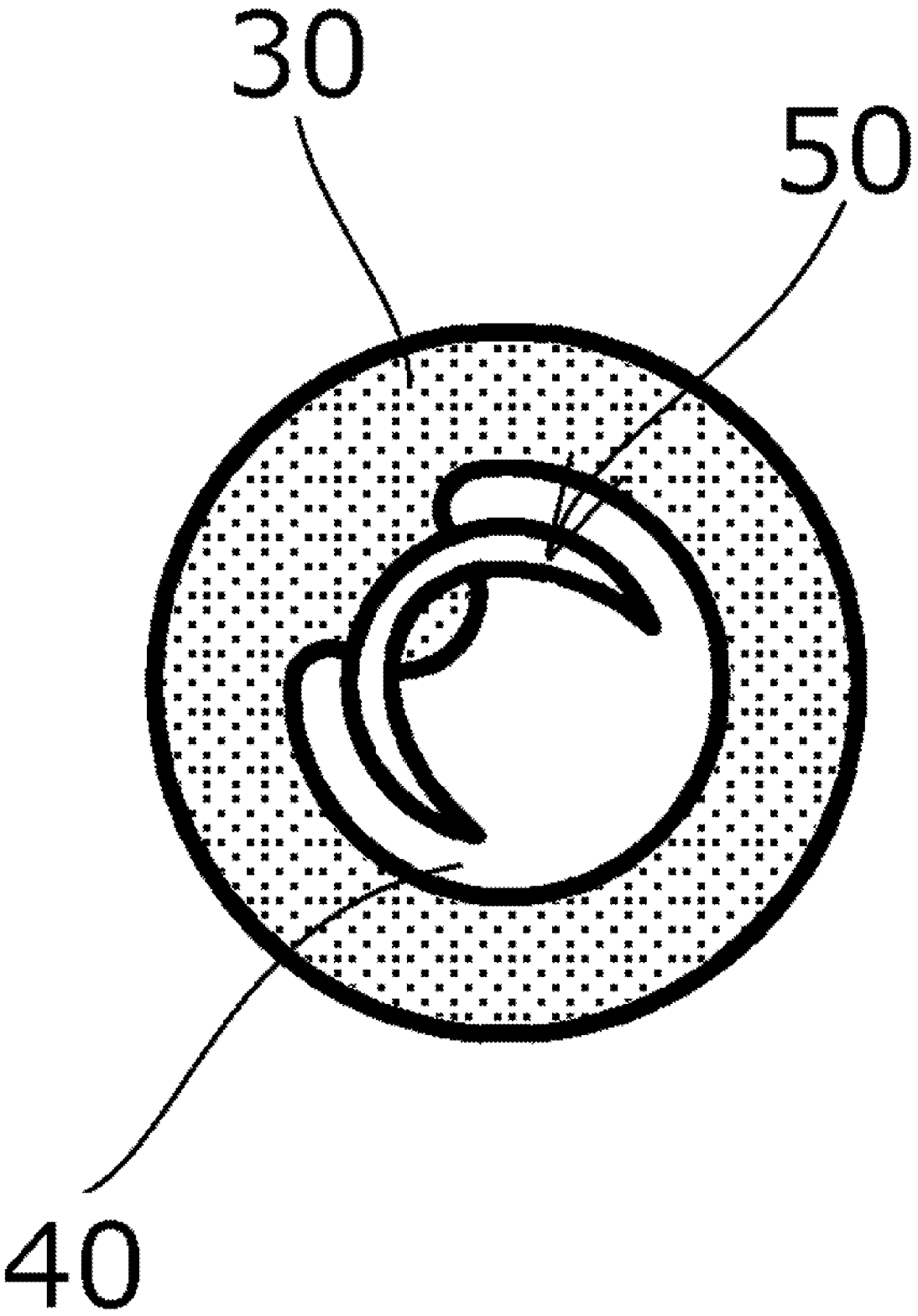
FIG. 7D is a plan view illustrating another variation example of the self-venting mechanism.
Figure 7E:
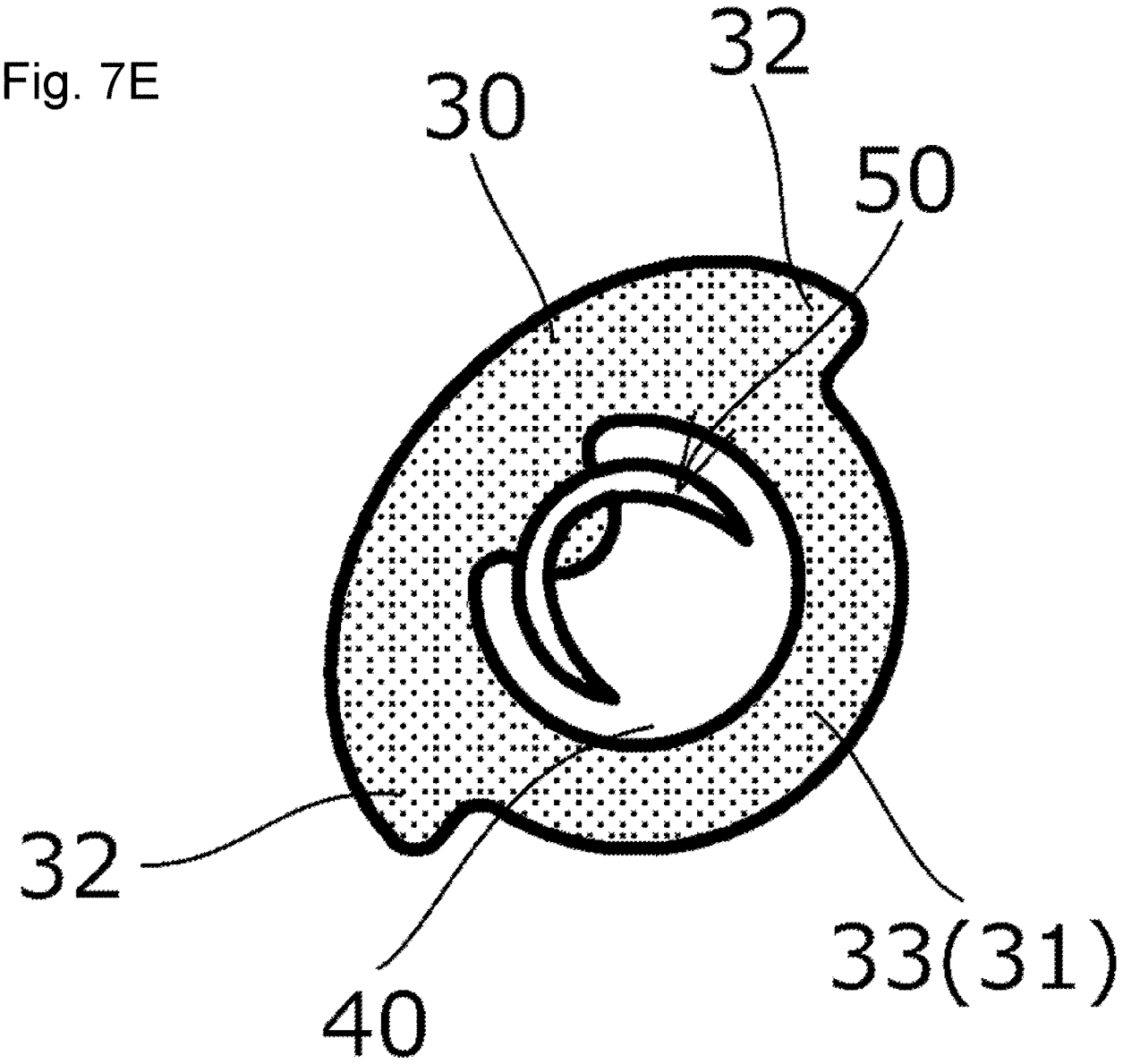
FIG. 7E is a plan view illustrating another variation example of the self-venting mechanism.

Alternatively, as a variation example of the venting seal 30, the venting seal 30 may be formed so as to include strong seal parts 32 and a weak seal part 33 formed circumferentially adjacent the strong seal parts 32 and having lower peel resistance than the strong seal parts 32, as shown in FIG. 7E. With this example shown in FIG. 7E, peeling is stopped by the strong seal parts 32, whereby it is possible to induce the seal peel initiation part 31 to start peeling by the steam in the weak seal part 33, and thus the direction in which the peeling progresses in the venting seal 30 and the steam release part 40 can be controlled. In the example shown in FIG. 7E, the weak seal part 33 of the venting seal 30 has a circumferentially smaller width than that of the strong seal parts 32 so as to provide a difference in the peel resistance between the strong seal parts 32 and the weak seal part 33. Other methods can be used to provide a difference in the peel resistance, such as, for example, changing the duration of thermal bonding so that there will be a difference in the bond strength.

Also, while the strong seal parts 32 are provided circumferentially on both sides of the weak seal part 33 of the venting seal 30 in the example shown in FIG. 7E, the strong seal part 32 may be provided on only one side of the weak seal part 33.

The term "peel resistance" as used herein refers to the ability to resist formation of a communication path between the radially outer side and the inner side of the venting seal 30 as the peeling progresses.

In the embodiment described above, the slit intermediate part 52 of the slit 50 is curved, but may have any other specific forms as long as the slit intermediate part 52 extends from the slit both ends 51 toward a region away from the seal peel initiation part 31 and connecting the slit both ends 51. For example, the slit intermediate part 52 may be formed by a plurality of straight or curved lines such as in a V shape or U shape, as shown in FIG. 7A.

In the embodiment described above, the slit 50 is formed in the steam release part 40 in its entirety, but instead, as shown in FIG. 7B to FIG. 7E and FIG. 9, part of the slit intermediate part 52 may be formed in the venting seal 30. In the examples shown in FIG. 7B to FIG. 7E and FIG. 9, part of the inner peripheral edge of the venting seal 30 protrudes radially inward.

Optionally, as in the examples shown in FIG. 7B or FIG. 9, the inner edge of the venting seal 30 may include a straight portion 34 extending parallel to the imaginary line L1 connecting the slit both ends 51, at a position corresponding to the peak of the slit 50. This can prevent changes in the performance of the movable piece 60 (self-venting mechanism 20) even when the position where the slit 50 is formed is somewhat displaced in the direction in which the imaginary line L1 extends.

In the embodiment described above, the slit 50 was described as a linear cut, but the slit 50 is not limited to this specific form and may have a predetermined width along the extending direction of the slit 50 as shown in FIG. 7D or FIG. 7E.

Figure 8:
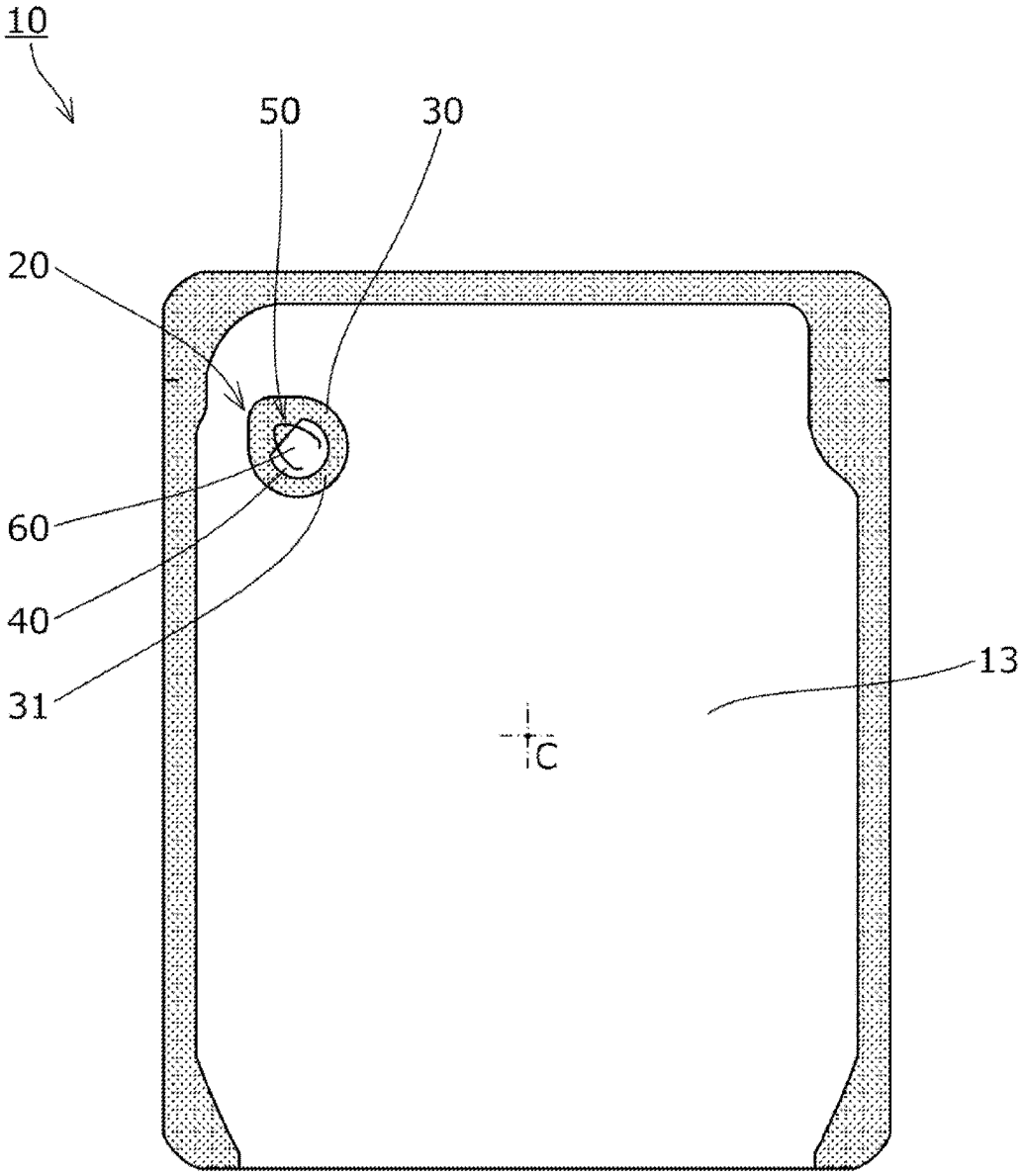
FIG. 8 is a plan view illustrating a variation example of the pouch.

Moreover, as in the examples shown in FIG. 8 and FIG. 9, at each of the slit both ends 51 of the slit intermediate part 52, there may be an end portion 52*a* that deviates from the imaginary line L2 as it extends further away from the seal peel initiation part 31. The pair of end portions 52*a* are formed to be increasingly spaced apart from each other as they extend away from the seal peel initiation part 31 as shown in FIG. 9. With the slit 50 formed in this way, the distance between the slit both ends 51, i.e., the width of the connecting portion 61 of the movable piece 60 is reduced, so that the movable piece 60 can more easily tilt to the front side or backside of the pouch 10. This not only facilitates formation of the ejection port 70 near the slit both ends 51, but also allows the ejection port 70 to open laterally and backward relative to the direction in which the steam and contents enter the steam release part 40. Thus spurting of the contents from the ejection port 70 can be minimized more reliably.

When the end portions 52*a* are to be provided, it is preferable to set the angle β of the end portion 52*a* relative to the imaginary line L1 in the range of 30° to 75°, and more preferably, 35° to 55°.

The length from the slit both end 51 to the end portion 52*a* should preferably set to be 1 mm or more, and more preferably set to be in the range of 1 mm to 3 mm.

The end portions 52*a* may be curved, or straight.

Figure 7F:
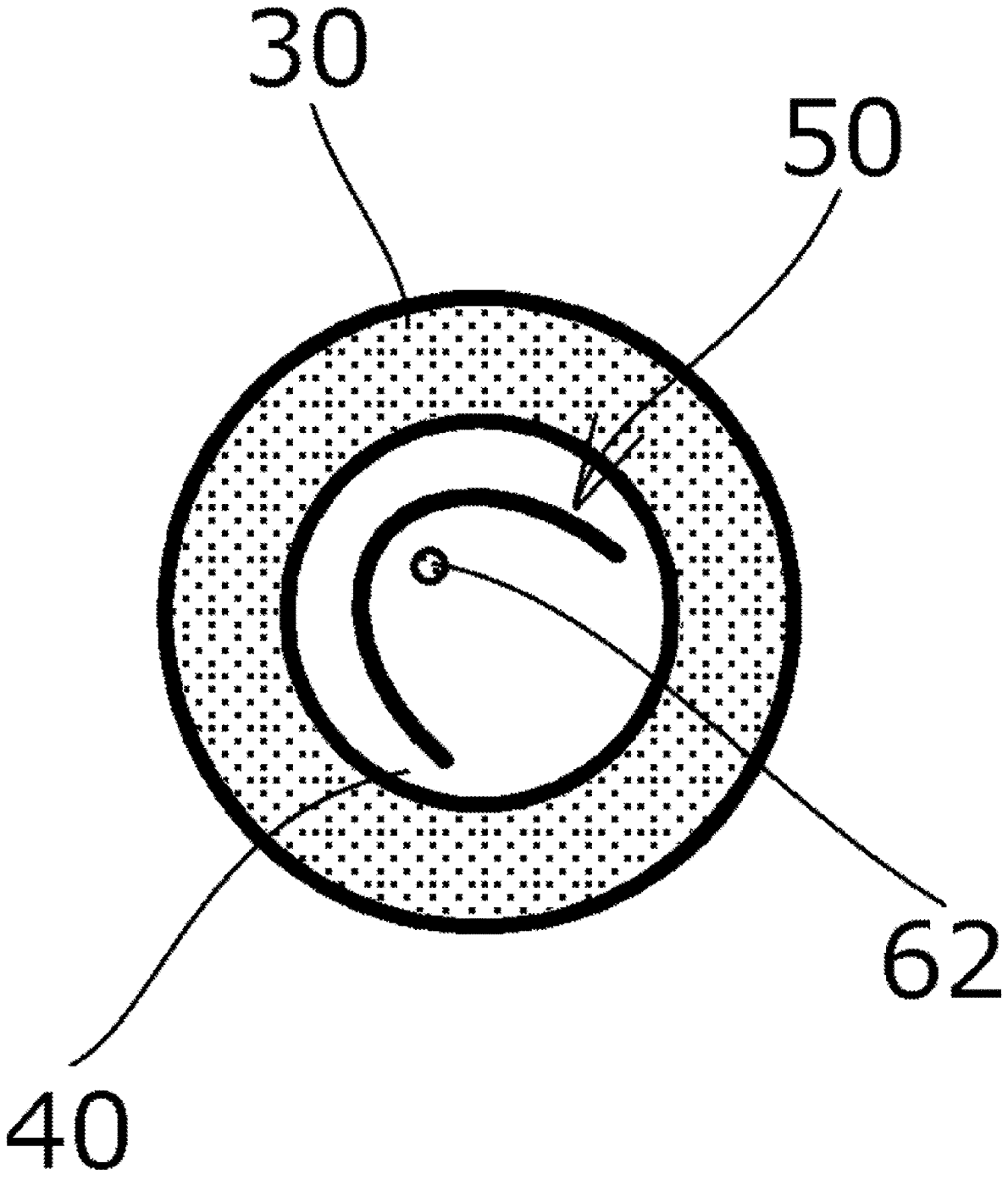
FIG. 7F is a plan view illustrating another variation example of the self-venting mechanism.

As shown in FIG. 7F, a point seal 62 may be formed at the distal end of the movable piece 60 by partially bonding together the overlapped layers of movable piece 60 with heat (laminated films 11 together).

The size of the movable piece 60 should preferably be set as follows:

The (maximum) length X of the movable piece 60, as shown in FIG. 9, along the direction in which the imaginary line L2 connecting the center C of the container part 13 of the pouch 10 and the center of the steam release part 40 extends, should preferably set to be 3 mm or more, and more preferably set to be in the range of 5 mm to 9 mm.

The (maximum) width Y of the movable piece 60 along the direction orthogonal to the imaginary line L2 should also preferably set to be 3 mm or more, and more preferably set to be in the range of 5 mm to 9 mm.

These size settings of the movable piece 60 apply not only to the variation examples shown in FIG. 8 and FIG. 9 but also to the examples shown in FIG. 1 and FIG. 7A to 7F.

With the (maximum) length X and (maximum) width Y of the movable piece 60 set as specified above, the tilting of the movable piece 60 toward the front side or backside of the pouch 10 can be controlled more reliably, so that the ejection port 70 can be opened favorably near the slit both ends 51.

Various features of the embodiment and variation examples described above can be combined in any way to form other pouches.

The invention claimed is:

1. A microwave pouch comprising a self-venting mechanism, the self-venting mechanism including an annular venting seal, a steam release part surrounded by the venting seal, and a movable piece defined by a slit formed in the steam release part, the venting seal including a seal peel initiation part where peeling is started by steam generated inside the pouch during heating, and the slit including slit both ends, and a slit intermediate part formed to extend from the slit both ends toward a region away from the seal peel initiation part and connecting the slit both ends, wherein part of the slit intermediate part is formed in the venting seal.

2. The microwave pouch according to claim 1, wherein a point seal is formed in the movable piece by thermally bonding together layers of the movable piece.

3. The microwave pouch according to claim 1, wherein the seal peel initiation part is a section of the annular venting seal closest to a center of a container part of the pouch.

4. The microwave pouch according to claim 1, wherein the slit has a width along a slit extending direction.

5. The microwave pouch according to claim 1, wherein a length of the movable piece along a direction in which an imaginary line connecting a center of a container part of the pouch and a center of the steam release part extends is set to be 3 mm or more, and a width of the movable piece along a direction orthogonal to the imaginary line is set to be 3 mm or more.

6. The microwave pouch according to claim 1, wherein the slit intermediate part has end portions each on either side at the slit both ends, and the pair of end portions is formed such that the end portions are increasingly spaced apart from each other as the end portions extend further from the seal peel initiation part.

7. A microwave pouch comprising a self-venting mechanism, the self-venting mechanism including an annular venting seal, a steam release part surrounded by the venting seal, and a movable piece defined by a slit formed in the steam release part, the venting seal including a seal peel initiation part where peeling is started by steam generated inside the pouch during heating, and the slit including slit both ends, and a slit intermediate part formed to extend from the slit both ends toward a region away from the seal peel initiation part and connecting the slit both ends, wherein a point seal is formed in the movable piece by thermally bonding together layers of the movable piece.

8. The microwave pouch according to claim 7, wherein the seal peel initiation part is a section of the annular venting seal closest to a center of a container part of the pouch.

9. The microwave pouch according to claim 7, wherein the slit has a width along a slit extending direction.

10. The microwave pouch according to claim 7, wherein a length of the movable piece along a direction in which an imaginary line connecting a center of a container part of the pouch and a center of the steam release part extends is set to be 3 mm or more, and a width of the movable piece along a direction orthogonal to the imaginary line is set to be 3 mm or more.

11. The microwave pouch according to claim 7, wherein the slit intermediate part has end portions each on either side at the slit both ends, and the pair of end portions is formed such that the end portions are increasingly spaced apart from each other as the end portions extend further from the seal peel initiation part.

* * * * *